US009184517B1

(12) United States Patent
Endacott

(10) Patent No.: US 9,184,517 B1
(45) Date of Patent: Nov. 10, 2015

(54) CRIMPABLE INSULATED ELECTRICAL CONNECTOR

(76) Inventor: John E. Endacott, Pensacola, FL (US)

( * ) Notice: Subject to any disclaimer, the term of this patent is extended or adjusted under 35 U.S.C. 154(b) by 153 days.

(21) Appl. No.: 12/928,436

(22) Filed: Dec. 13, 2010

(51) Int. Cl.
*H01R 4/00* (2006.01)
*H01R 4/70* (2006.01)

(52) U.S. Cl.
CPC ..... *H01R 4/70* (2013.01)

(58) Field of Classification Search
CPC ..... H01R 4/726; H01R 4/72; H01R 4/70; H02G 15/1806
USPC .... 174/88, 74 A, 74 R, 80, 84 R, 88 C, 88 R, 174/84 C, 70 R; 29/868, 869; 439/523, 439/877–882, 932, 442, 585; 428/34.9
See application file for complete search history.

(56) References Cited

U.S. PATENT DOCUMENTS 3,143,595 A * 8/1964 Martin ..... H01R 4/72 174/84 C
3,708,611 A * 1/1973 Dinger ..... 174/84 C
4,595,724 A * 6/1986 Koblitz ..... C08K 3/22 174/74 A
4,993,149 A * 2/1991 Zilligen et al. ..... 29/859
5,393,932 A * 2/1995 Young et al. ..... 174/84 R
6,454,598 B1 * 9/2002 Burwell et al. ..... 439/523
6,838,621 B2 1/2005 Endacott
7,256,348 B1 * 8/2007 Endacott ..... 174/84 R
2004/0074667 A1 * 4/2004 Endacott ..... H01R 4/187 174/84 R

OTHER PUBLICATIONS

Color-Keyed Connector Compression; Published in 2002.*

* cited by examiner

*Primary Examiner* — Jenny L Wagner
*Assistant Examiner* — Pete Lee
(74) *Attorney, Agent, or Firm* — Peter Loffler

(57) ABSTRACT

An electrical connector electrically connects two or more conductors in end to end orientation such that a bared end of each conductor is positioned within a hollow crimp barrel and crimped therein. The crimp barrel is held within a heat shrinkable sleeve that is crystal clear. Openings on either side of a stop within the crimp barrel allow for visual access into the central channel within the crimp barrel to assure proper placement and subsequent crimping of the conductors.

8 Claims, 3 Drawing Sheets

CRIMPABLE INSULATED ELECTRICAL CONNECTOR

BACKGROUND OF THE INVENTION

1. Field of the Invention

The present invention relates to a connector that electrically and mechanically connects a pair of conductors in an end to end orientation wherein the bared ends conductors are crimped within a crimp barrel and wherein the crimp barrel is disposed within a heat shrinkable sleeve wherein the sleeve and its inner adhesive layer are crystal clear, in particular transparent, essentially see-through.

2. Background of the Prior Art

Crimping two electrical conductors in end to end orientation is well known in the art. Typically, the bared ends of the two (or more) conductors are brought into an end to end orientation within a malleable and electrically conductive crimp barrel and, using a crimping tool, the crimp barrel is crimped on either side of the center of the barrel in order to assure that each conductor is crimped within the barrel. If performed properly, the crimping of the two conductors produces a solid electrical and mechanical connection of the conductors. Oftentimes, a less than ideal crimp is performed. For example, if one of the conductors is stripped too short, the crimp is performed on the end of that conductor resulting in poor termination. If one or both of the conductors are not fully inserted within the crimp barrel the result is also poor termination. To compound the problem, the only quality control test that many technicians perform on the connected conductors is to pull on the two conductors after they are crimped together. This is due to the fact that the crimp barrel is solid and there is no realistic method to see the results from the crimp that has been performed. In many instances, a poor crimp withstands this single tensile test only to fail later, possibly at a critical time in the field.

In one of my previous patents, U.S. Pat. No. 7,256,348 issued on Aug. 14, 2007, I addressed the issue by providing an opening on either side of the central stop that allows a technician to see the conductors both before and after the crimp is performed. These openings allow for visual inspection of the crimp.

However, a problem remains in that the crimp barrel is held within a heat shrinkable sleeve which sleeve has a layer of a heat activated adhesive on its inner surface. After the crimp is performed, the sleeve is subject to heat in order to activate the adhesive and also allow the sleeve to heat shrink onto the barrel. The sleeve, coupled with the adhesive, provide an essentially watertight insulative cover for the connection. The problem with the heat shrinkable sleeve system is that the sleeve is tinted for various reasons, such as to assure that the proper gauge of wire is used with the particular crimp connector. The tinting, coupled with the adhesive layer, especially after heat activation, tends to cloud up or haze the sleeve so that a visual inspection of the final crimped product is still difficult, resulting in many poor crimping connections not being caught during a quality control inspection. Even sleeves that are colorless tend to make visual inspection of the crimp difficult due to the cloudiness of the sleeves and adhesive.

What is needed is a crimp connector that joins two (or more) electrical conductors in end to end fashion with the use of a heat shrinkable insulating sleeve wherein the crimp portion of the connection process can be clearly and easily inspected visually both before or after the heat shrinking of the sleeve.

SUMMARY OF THE INVENTION

Inventors Douglas Neil Burwell and Sharon Elizabeth Macey have discovered a new type of heat shrinkable sleeve, which they refer to as an ionomer based sleeve, and which is disclosed in at least U.S. Pat. No. 6,454,598, issued on Sep. 24, 2002, which patent is incorporated herein by reference in its entirety. While the inventors generally speak of their ionomer sleeve as being tinted, it has been found that this type of sleeve can also be produced untinted with the result that the sleeve including its adhesive layer is crystal clear, in particular transparent and essentially see through both before and after the heat shrinking process. I have used the ionomer based sleeve to produce a crimpable insulated electrical connector that allows quick and easy visual inspection of the crimp both before or after the heat shrink process.

The crimpable insulated electrical connector of the present invention is comprised of a crimpable tubular barrel that has a central channel with a first end that receives a portion of at least one electrical conductor, the barrel also having a second end that also receives a portion of at least another electrical conductor. The barrel has a stop disposed within the channel. A first opening is located on a first side of the stop while a second opening is located on a second side of the stop such that the first opening and the second opening each give visual access into the channel at the critical area where the crimp is performed. A heat shrinkable hollow sleeve receives the barrel therein such that barrel is fully disposed within the sleeve. The sleeve has a heat activated adhesive inner surface layer such that the sleeve, including its adhesive layer, is crystal clear. A first band encircles the barrel between the first end and the first opening, the first band being located at a first sweet spot for crimping while a second band encircles the barrel between the second end and the second opening, the second band being located at a second sweet spot for crimping. The first band is of a first color which first color corresponds to a gauge of the first conductor to be received within the first end of the channel and the second band is of a second color which second color corresponds to a gauge of the second conductor to be received within the second end of the channel. The first color and the second color are the same color, although they may be different if the channel is stepped or otherwise sized to receive conductors of dissimilar gauges. The sleeve is ionomer-based, that is it is made via the teachings of U.S. Pat. No. 6,454,598.

BRIEF DESCRIPTION OF THE DRAWINGS

Similar reference numerals refer to similar parts throughout the several views of the drawings.

DESCRIPTION OF THE PREFERRED EMBODIMENT

Figure 1:
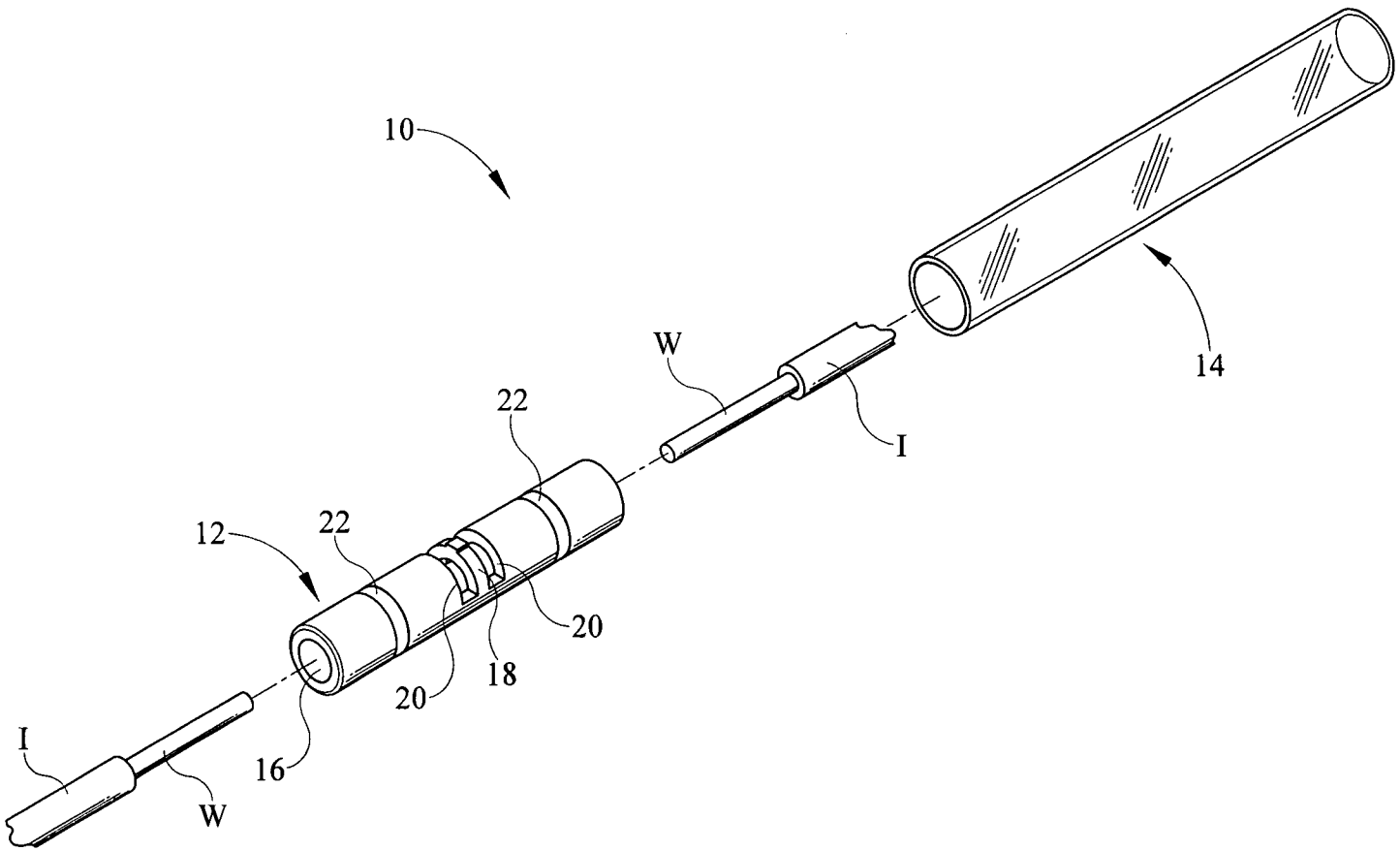
FIG. 1 is an exploded perspective view of the components of the crimpable insulated electrical connector of the present invention.
Figure 2:
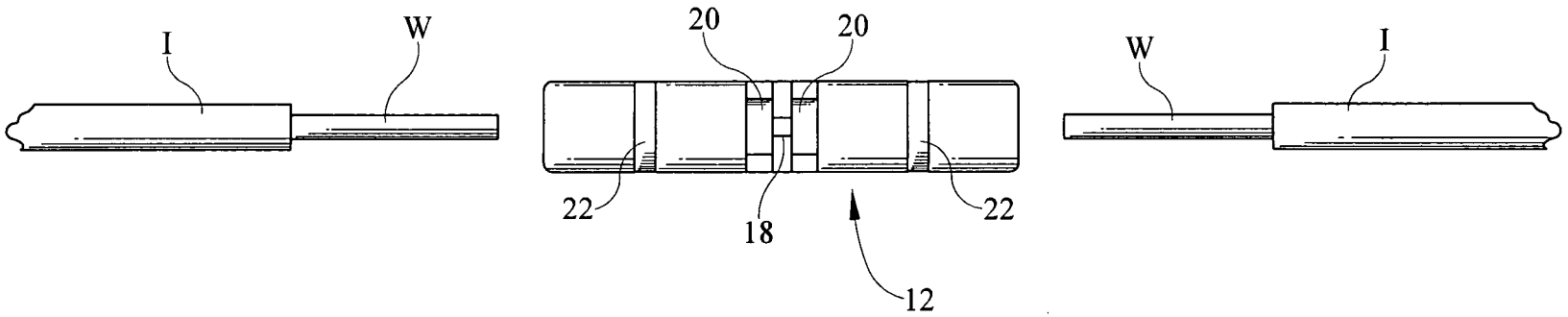
FIG. 2 is an elevation view of two wires about to be positioned within the crimp barrel of the crimpable insulated electrical connector.
Figure 3:
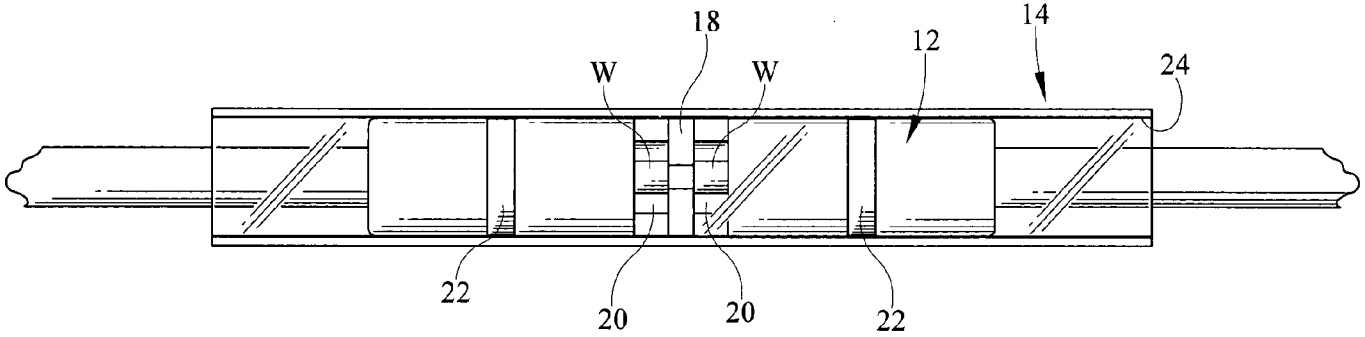
FIG. 3 is an elevation view of the crimpable insulated electrical connector just prior to the crimping and heat shrinking processes.
Figure 4:
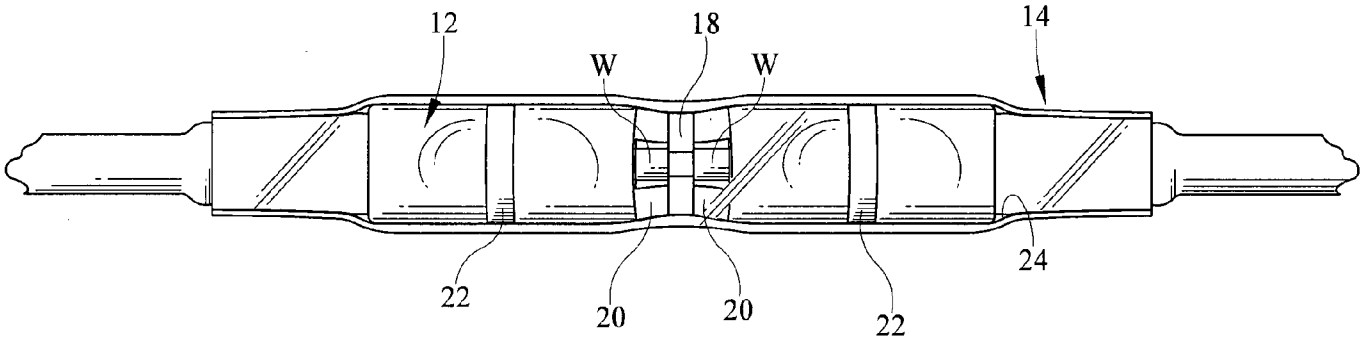
FIG. 4 is an elevation of a completed connection of two conductors using the crimpable insulated electrical connector.

Referring now to the drawings, it is seen that the crimpable insulated electrical connector of the present invention, generally denoted by reference numeral 10, is comprised of two main components, the crimp barrel 12 and the heat shrinkable insulative sleeve 14. The crimp barrel 12, which is made from any appropriate crimping material known in the art for electrical connectors, such as tin plated copper, is a tubular member that has a hollow passage or channel 16 passing longitudinally therethrough. The diameter of the hollow channel 16 is dependent on the gauge of the wires W to be crimped by the barrel 12 such that the conductors W fit snugly when inserted into the channel 16 as more fully discussed below. Disposed (centrally or otherwise) within the channel 16 is a stop 18. Located on either side of the stop is a pair of openings 20 or cutaway sections of the crimp barrel 12 which openings 20 allow visual access into the channel 16 proximate the stop 18.

Located between each opening 20 and its respective end of the barrel 12 is a color band 22 that encircles the crimp barrel 12. The color bands 22 serve two purposes. First, the color bands 22 come in a variety of colors, the specific color of the band 22 encircling the crimp barrel 12 being dependent on the gauge of conductor that is to be received by the crimp barrel 12. This allows a technician to be able to quickly select the appropriate sized connector 10 for the gauge of conductors W being connected simply by looking at the color band(s) 22—the bands 22 may each be a different color on the same crimp barrel 12 if two conductors W of different gauges are being connected as was disclosed in my previously mentioned patent. Additionally, the color bands 22 are positioned right on the sweet spot for the crimp process so that the technician centers the crimp tool (not illustrated) on the each band 22 and crimps.

The heat shrinkable sleeve 14 is also a tubular member that receives the crimp barrel 12 therein in a snug fashion (the sleeve 14 is heat shrunk onto crimp barrel 12) so that the crimp barrel 12 maintains its position within the sleeve 14 even during hard positioning of the conductors W within the crimp barrel 12. The sleeve 14 has an adhesive layer 24 located on its inner surface. The adhesive layer 24 is heat activated and is typically coextruded with the remainder of the sleeve 14. The shrink ratio of the sleeve tends to be on the order of about 3 to 1, more or less. The sleeve 14 is ionomer-based as disclosed in U.S. Pat. No. 6,454,598 and the sleeve 14 including its adhesive layer 24 are crystal clear both before and after the heat shrinking process.

In order to use the crimpable insulated electrical connector 10 of the present invention, a pair of conductors W each have their ends stripped bare and each conductor W is inserted into the crimp barrel 12, one conductor W on each end of the barrel 12. Each conductor W is inserted until the conductor W abuts against the stop 18. Once each conductor W is positioned, the technician can make a visual inspection to assure that each conductor W is properly stripped and is properly seated within the crimp barrel 12. The technician thereafter crimps each side of the barrel 12 using the color bands 22 as the positioning guide for the crimp tool. Once the crimps are performed, another visual inspection can be made to assure that the crimping was performed properly. Thereafter, the non-heat shrunk outer ends of the sleeve 14 (the central portion of the sleeve 14 being heat shrunk onto crimp barrel 12 as discussed earlier) are heated as appropriate in order to activate the adhesive 24 and to heat shrink the sleeve 14 onto the crimp barrel 12 and onto a portion of the insulation I of the conductors W in order to insulate the electrical connection. A final visual inspection of the overall job can thereafter be performed.

Although the conductors W are illustrated as wires, any conductors that are appropriate for crimp connections can be used.

While the invention has been particularly shown and described with reference to an embodiment thereof, it will be appreciated by those skilled in the art that various changes in form and detail may be made without departing from the spirit and scope of the invention.

I claim:

1. An electrical connector for connecting two electrical conductors, each of the same gauge, each of the two electrical conductors crimp connected with the electrical connector at a first spot for crimping and a second spot for crimping respectively, the electrical connector comprising:

a crimpable tubular barrel having a central longitudinal channel with a first end, having a first inside diameter and adapted to receive a portion of at least one of the electrical conductors and having a second end having a second inside diameter that is the same as the first inside diameter and adapted to receive a portion of another of the electrical conductors, the barrel, having a stop disposed within the channel, a first opening located on a first side of the stop, and a second opening located on a second side of the stop, the first opening and the second opening each giving visual access into the channel; and an untinted ionomer-based heat shrinkable hollow sleeve for receiving the barrel therein such that barrel is fully disposed within the sleeve, the sleeve having a heat activated adhesive laden inner surface such that the sleeve including its adhesive laden inner surface is transparent and is crystal clear in its heat shrunk state after being heat shrinked.

2. The electrical connector as in claim 1 further comprising:

a first band encircling the barrel between the first end and the first opening, the first band being located at the first spot for crimping; and a second band encircling the barrel between the second end and the second opening, the second band being located at the second spot for crimping.

3. The electrical connector as in claim 2 wherein the first band is of a first color which first color corresponds to a gauge of the first conductor to be received by the channel and the second band is of a second color which second color corresponds to a gauge of the second conductor to be received by the channel.

4. The electrical connector as in claim 3 wherein the first color and the second color are the same color.

5. An electrical connector for connecting two electrical conductors, each of the same gauge, each of the two electrical conductors crimp connected with the electrical connector at a first spot for crimping and a second spot for crimping respectively, the electrical connector comprising:

a crimpable tubular barrel having a central longitudinal channel with a first end, having a first inside diameter and adapted to receive a portion of at least one of the electrical conductors and having a second end having a second inside diameter that is the same as the first inside diameter and adapted to receive a portion of another of the electrical conductors, the barrel, having a stop disposed within the channel, a first opening located on a first side of the stop, and a second opening located on a second side of the stop, the first opening and the second opening each giving visual access into the channel;

an untinted ionomer-based heat shrinkable hollow sleeve for receiving the barrel therein such that barrel is fully disposed within the sleeve, the sleeve having a heat activated adhesive laden inner surface such that the sleeve including its adhesive laden inner surface is transparent and is crystal clear in its heat shrunk state after being heat shrinked;

a first band encircling the barrel between the first end and the first opening, the first band being located at the first spot for crimping; and a second band encircling the barrel between the second end and the second opening, the second band being located at the second spot for crimping.

6. The electrical connector as in claim 5 wherein the first band is of a first color which first color corresponds to a gauge of the first conductor to be received by the channel and the second band is of a second color which second color corresponds to a gauge of the second conductor to be received by the channel.

7. The electrical connector as in claim 6 wherein the first color and the second color are the same color.

8. An electrical connector for connecting two electrical conductors, each of the same gauge, each of the two electrical conductors crimp connected with the electrical connector at a first spot for crimping and a second spot for crimping respectively, the electrical connector comprising:

a crimpable tubular barrel having a central longitudinal channel with a first end, having a first inside diameter and adapted to receive a portion of at least one of the electrical conductors and having a second end having a second inside diameter that is the same as the first inside diameter and adapted to receive a portion of another of the electrical conductors, the barrel, having a stop disposed within the channel, a first opening located on a first side of the stop, and a second opening located on a second side of the stop, the first opening and the second opening each giving visual access into the channel;

an untinted ionomer-based heat shrinkable hollow sleeve for receiving the barrel therein such that barrel is fully disposed within the sleeve, the sleeve having a heat activated adhesive laden inner surface such that the sleeve including its adhesive laden inner surface is transparent and is crystal clear in its heat shrunk state after being heat shrinked; and at least one band encircling the barrel wherein the band is of a color which corresponds to a gauge of the conductors to be received by the channel.

* * * * *